US007836612B2

(12) United States Patent
Agnew et al.

(10) Patent No.: US 7,836,612 B2
(45) Date of Patent: Nov. 23, 2010

(54) SKI BOOT

(76) Inventors: Brian Michael Agnew, 10030 Howard Rd., Harrison, OH (US) 45030; Brenden O'Brien, 1616 N. Paulina St., Floor #2, Chicago, IL (US) 60622

( * ) Notice: Subject to any disclaimer, the term of this patent is extended or adjusted under 35 U.S.C. 154(b) by 747 days.

(21) Appl. No.: 11/771,892

(22) Filed: Jun. 29, 2007

(65) Prior Publication Data

US 2009/0000152 A1 Jan. 1, 2009

(51) Int. Cl.
*A43B 19/00* (2006.01)
*A43B 5/04* (2006.01)

(52) U.S. Cl. ..... 36/117.6; 36/10; 36/118.9

(58) Field of Classification Search ..... 36/117.6, 36/10, 118.9, 118.2, 118.4, 118.7, 118.8
See application file for complete search history.

(56) References Cited

U.S. PATENT DOCUMENTS

| | | | | |
|---|---|---|---|---|
| 2,343,477 | A * | 3/1944 | Ross | 36/10 |
| 3,713,231 | A * | 1/1973 | Mochizuki | 36/118.8 |
| 4,759,137 | A * | 7/1988 | Lederer | 36/117.6 |
| 5,740,620 | A * | 4/1998 | Giese et al. | 36/118.2 |
| 6,026,596 | A * | 2/2000 | Seidel | 36/117.4 |
| 6,226,898 | B1 * | 5/2001 | Trimble et al. | 36/118.2 |
| 7,584,552 | B2 * | 9/2009 | Krauss | 36/7.1 R |
| 2004/0244221 | A1 * | 12/2004 | Hall et al. | 36/10 |
| 2006/0174517 | A1 * | 8/2006 | Chang | 36/55 |

* cited by examiner

*Primary Examiner*—Ted Kavanaugh
(74) *Attorney, Agent, or Firm*—LAFKAS LLC; David M. Lafkas; Matthew E. Vale

(57) ABSTRACT

A ski boot is provided that includes an outer shell, an inner liner disposed within the outer shell and a functional shoe insertable into and removable from the inner liner by means of a rearforward to forward manner.

15 Claims, 6 Drawing Sheets

SKI BOOT

FIELD OF THE INVENTION

The present invention relates generally to boots, and more particularly, to ski boots.

BACKGROUND OF THE INVENTION

Known ski boots include a relatively rigid outer shell, which is effective for transferring body movements to the skis, and a plastic coated soft, and sometimes removable liner inserted into the outer shell. The outer shell can be made of a plastic material such as a rigid polyurethane. While existing ski boots have enjoyed widespread use, they are subject to certain disadvantages. For example, existing ski boots are heavy, uncomfortable, and awkward when walking.

Although some liners are removable, they may have a relatively smooth sole to mate with the corresponding inner surface of the outer shell. Significantly, the user may be subject to slipping while walking or climbing in snow while wearing the inner liner. Also, the liner design may not be aesthetically appealing so that the liner may not be suitable for wear in certain situations, for example in a ski lodge or other social environment.

Some inner liners can be heated prior to the initial insertion into the outer shell, so that the liner is "custom fit" when the user inserts his foot into the boot while the liner remains heated. This can be a relatively expensive and awkward process due to the size and shape of the liner.

Presently, the majority of ski boots are configured such that the inner liner and user's foot and lower leg must be inserted into the outer shell in a top to bottom, or substantially top to bottom direction. This can be a somewhat difficult procedure. Other inventions have tried to ease the difficulty of putting on ski boots although they still limit the skier to a ski boot liner which is uncomfortable, bulky, and awkward to walk in even if it is removable.

In view of the foregoing, there is a need for an improved ski boot with a functional, comfortable, and insertable/removable shoe.

SUMMARY OF THE INVENTION

The present invention overcomes the foregoing and other shortcomings and drawbacks of ski boots heretofore known. While the invention will be described in connection with certain embodiments, it will be understood that the invention is not limited to these embodiments. On the contrary, the invention includes all alternatives, modifications and equivalents as may be included within the spirit and scope of the present invention.

In view of the foregoing, a ski boot is provided that includes an outer shell, an inner liner disposed within and secured to the outer shell and a shoe insertable into and removable from the inner liner.

In other embodiments, the ski boot may include one or more of the following features. The outer shell may comprise an upper and a heel and cuff portion, with the heel and cuff portion being disposed outward of the upper and pivotally coupled to the upper. Unlike all known ski boots, the heel and cuff portion may be pivoted through an arc, which may be at least about 70 degrees, from an upper position (locked 'skiing' position) to a lower (unlocked 'non-skiing') position. The shoe may be insertable into the inner liner in a substantially rearward to forward direction when the heel and cuff portion is pivoted to the lower position. The ski boot may include at least one pivot device having a head disposed exterior of the heel and cuff portion and a toothed gear (one way clutch) coupled to the head and disposed inside the outer shell. The pivot device may further include a locking member disposed inside and secured to the outer shell, wherein the head and the toothed gear are pivotal with the heel and cuff portion and the locking member engages the toothed gear as it pivots.

The upper of the outer shell includes a rear portion that may have a slit formed therein. Similarly, the inner liner includes an upper having a rear portion that may have a slit formed therein and the heel and cuff portion of the outer shell has a forward portion that may include a slit formed therein. The slits formed in the rear portion of the upper of the outer shell, the rear portion of the inner liner and the forward portion of the heel and cuff portion may combine to permit the shoe to be inserted into the inner liner in a substantially rearward to forward direction.

The upper of the outer shell may be made of a plastic material and at least a portion of the inner liner may be made of a thermally moldable material. The inner liner may be bonded to the outer shell.

The shoe may include a sole having a lower surface and a tread pattern formed therein. The shoe may further include an upper secured to the sole, with the upper having an upper opening, a front end, medial and lateral sides, and a longitudinal opening extending from the upper opening toward the front end, with the longitudinal opening separating the medial and lateral sides. The shoe may further include a tongue being disposed in the longitudinal opening but secured at the front lower portion of the shoe as well as secured to the lateral and medial sides of the uppers longitudinal opening. Over the tongue, the shoe may include a tightening device extending between the medial and lateral sides across the longitudinal opening. The tightening device may include a zipper.

In the illustrated embodiment, the ski boot of the present invention includes a functional shoe that is easily inserted into the inner liner and outer shell of the boot in a substantially rearward to forward direction. The shoe may be removed in the same manner. The shoe may include an aesthetically pleasing design so that it is suitable to be worn in a ski lodge or a variety of other social environments. Additionally, the shoe may include a sole having a tread pattern so that the user is less likely to slip while walking on a snow-covered surface.

These and other objects and advantages of the present invention will be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and a detailed description of the embodiments given below, serve to explain the principles of the invention.

DETAILED DESCRIPTION OF THE PREFERRED EMBODIMENTS

Figure 1:
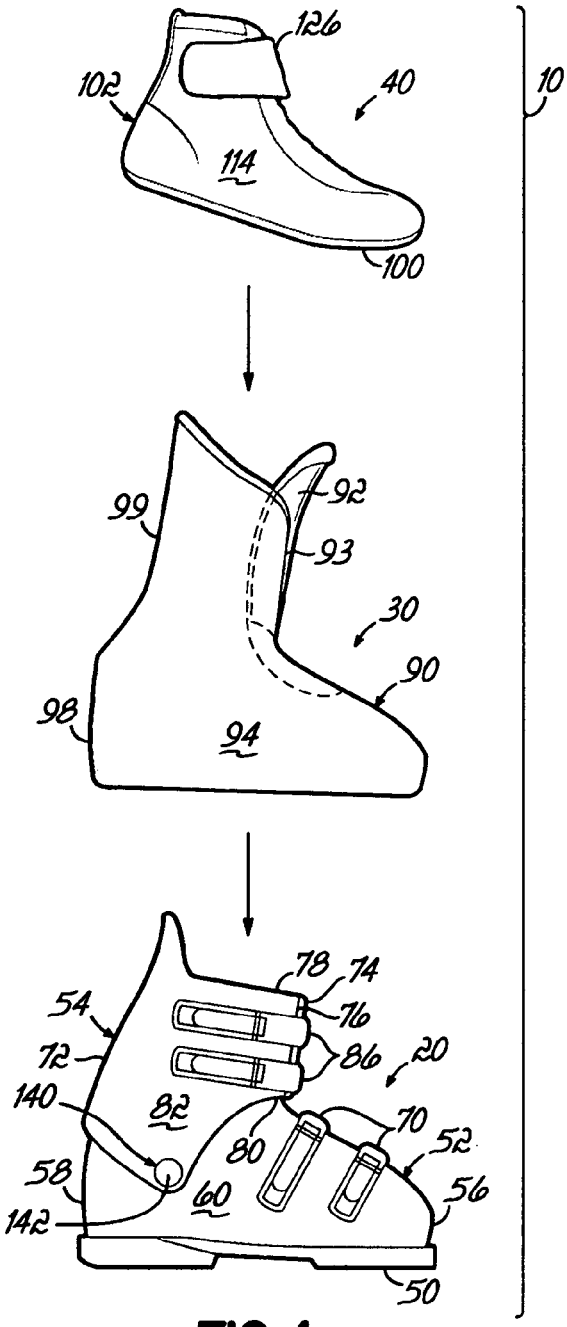
FIG. 1 is an exploded assembly view, illustrating a ski boot according to one embodiment of the present invention.

Referring now to the drawings, FIG. 1 illustrates a ski boot 10 according to an embodiment of the present invention. Ski boot 10 includes an outer shell 20 and an inner liner 30 disposed within and secured to the outer shell 20. The ski boot 10 further includes a shoe 40 that is insertable into and removable from the inner liner 30.

Outer shell 20 includes a sole 50 and an upper 52 secured to sole 50. Outer shell 20 further includes a heel and cuff portion 54 that is disposed outward of shell 20 and is pivotally coupled to upper 50 as subsequently discussed further. Upper 52 and heel and cuff portion 54 of outer shell 20 may be made of a relatively rigid material that may be a plastic material, so outer shell 20 is effective for transferring body movements to the user's skis. An example of a suitable material is polyurethane.

The upper 52 includes a front portion 56, a rear portion 58, a lateral side 60 and a medial side 62. Sides 60, 62 extend between the front 56 and rear 58 portions. Upper 52 further includes a slit or opening 64 formed in rear portion 58 that extends from a top 66 of upper 52 of outer shell 20 toward sole 50. The presence of slit 64 permits the lateral 60 and medial 62 sides of upper 52 to be separated from one another. Upper 52 also includes a longitudinal slit or opening 68 that extends from top 66 toward front portion 56 between the lateral 60 (FIG. 1) and medial 62 (FIGS. 4B, 5) sides of upper 52. While the lateral 60 and medial 62 sides are disposed in close proximity to one another at top 66, sides 60 and 62 are disposed in overlapping relationship with one another starting at a location away from top 66 and extending to front portion 66 to provide the desired seal during use. A plurality of conventional fastening devices 70 may be secured to upper 52 so that they extend across longitudinal opening 68. Each fastening device 70 may include a buckle secured to one of the lateral 60 and medial 62 sides and an associated ridged strap (FIG. 5) secured to the other of lateral 60 and medial 62 sides, as known in the art. Fastening devices 70 may be adjusted as required to provide the desired snug fit for a particular user. In addition, the upper cuff portion 54 may have a universal Velcrow strap (not shown) that additionally tightens lateral side 82 and medial side 84. The Velcrow strap (not shown) may be connected to the rear upper cuff portion 54.

Figure 5:
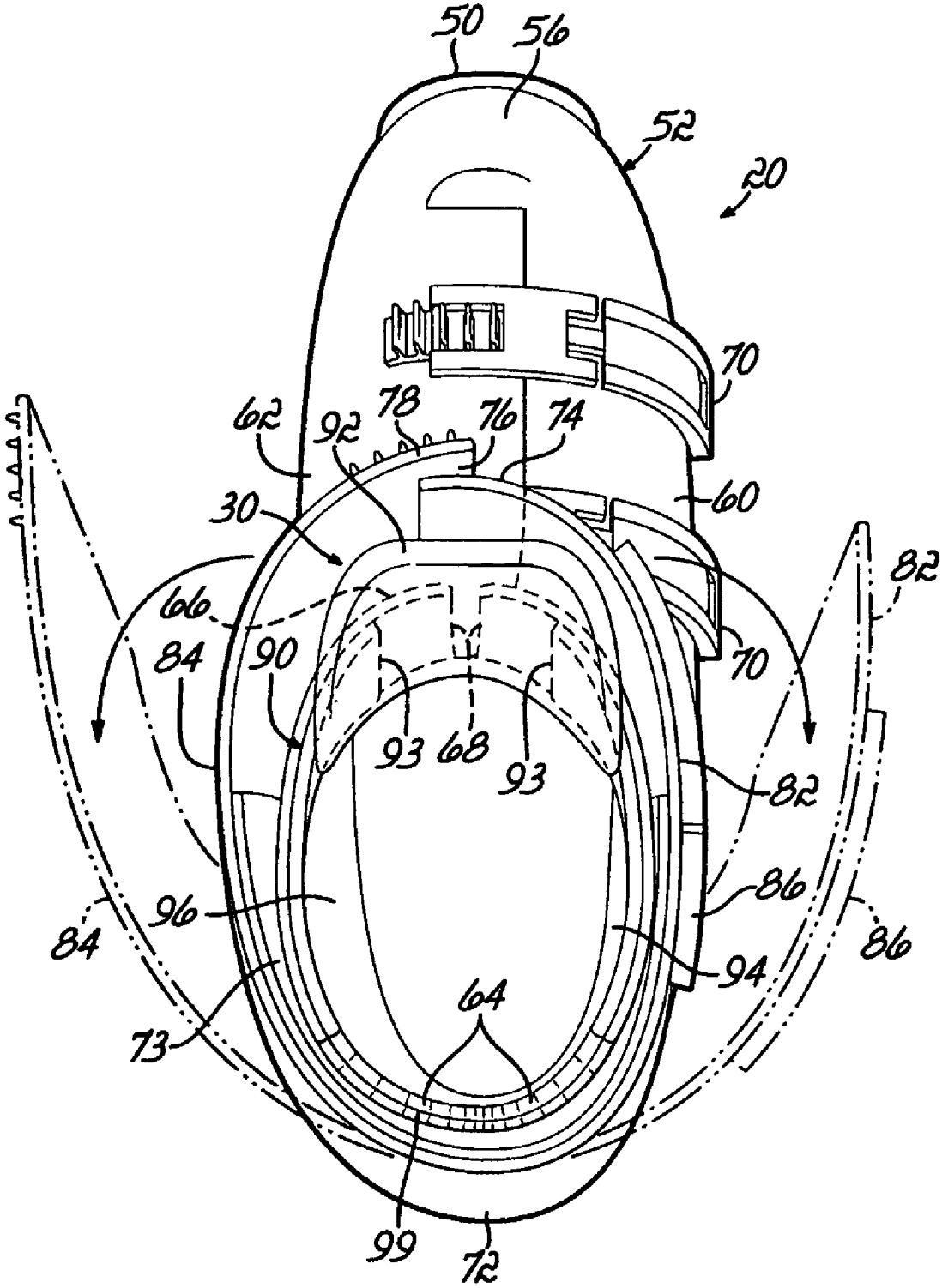
FIG. 5 is a top plan view of the outer shell and inner liner of the ski boot shown in FIG. 1.

The heel and cuff portion 54 of outer shell 20 includes a rear portion 72 disposed so that it covers the opening 64 formed in the rear portion 58 of upper 22 when the heel and cuff portion 54 is in an upper position, which is the use position, as shown in FIG. 1. Heel and cuff portion 54 may also include a panel 73 secured, such as by bonding, to an inner surface of the rear portion 72. Panel 73 may be included for a subsequently described purpose. The heel and cuff portion 54 further includes a front portion 74 having a slit 76 formed therein. Slit 76 extends from a top 78 to a bottom 80 of front portion 74, between a lateral side 82 and a medial side 84 of heel and cuff portion 54, thereby permitting the lateral side 82 and medial side 84 to be separated during insertion of shoe 40 into inner liner 30 when the heel and cuff portion 54 has been pivoted to a lower position shown in FIG. 3B. However, the lateral 82 and medial 84 sides of heel and cuff portion 54 are disposed in overlapping relationship with one another when heel and cuff portion 54 is in an upper position, as best seen in FIG. 5. A plurality of conventional fastening devices 86, which may be buckles and associated straps, may be secured to the lateral side 82 and medial side 84 of heel and cuff portion 54 in a manner known in the art. Fastening devices 86 span across slit 76 in front portion 74 and may be adjusted as required to provide the desired fit for a particular user.

The inner liner 30 may be made of a thermally moldable material, such as a foam material. An example of a suitable material is Ultralon® foam. Inner liner 30 includes an upper 90 and a tongue 92 secured at a lower end to upper 90. Tongue 92 is disposed in an opening 93 disposed between a lateral side 94 and a medial side 96 (shown in FIG. 4) of upper 90. Inner liner 30 may be secured, at various locations, to the inside of outer shell 20. Inner liner 30 may be bonded to outer shell 20, by using a conventional adhesive for example. Alternatively, inner liner 30 may be otherwise secured to outer shell 20 using any other suitable means. In the illustrated embodiment, the upper 90 is a single piece. However, in other embodiments the upper 90 may have multiple pieces or portions that are individually secured, such as by bonding, to the outer shell 20. The tongue 92 is not secured to outer shell 20 so that it can move with the corresponding portion of shell 20 during use. The upper 90 of inner liner 30 includes a rear portion 98 having a slit 99 formed therein. The presence of slit 99 permits the lateral side 94 and medial side 96 of inner liner 30 to be separated during insertion of shoe 40 into liner 30. In a use position, the panel 73 of heel and cuff portion 54 spans across slit 99, for at least a portion of the length of slit 99, to provide the desired seal. Panel 73 may be made of the same material as inner liner 30 or other suitable materials.

Figure 2:
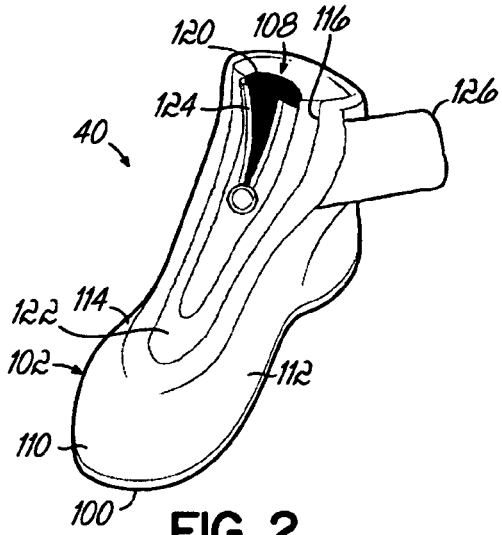
FIG. 2 is a perspective view of the shoe of the ski boot shown in FIG. 1.
Figure 2A:
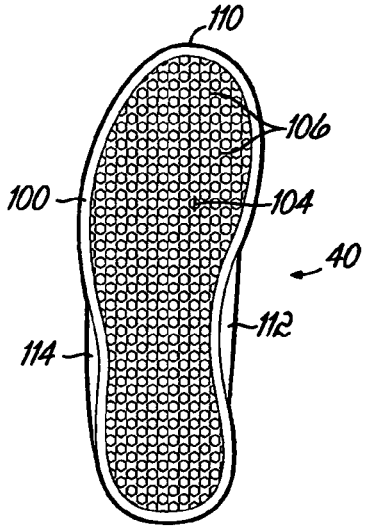
FIG. 2A is a bottom plan view of the shoe shown in FIGS. 1 and 2.
Figure 2B:
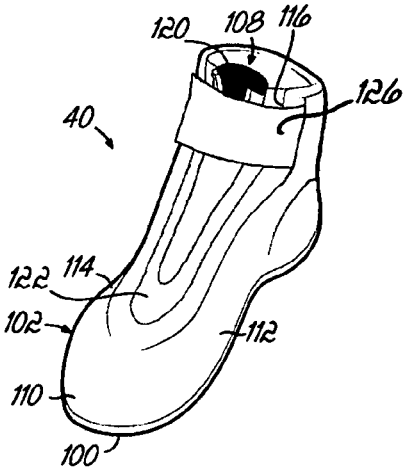
FIG. 2B is a perspective view of the shoe of the ski boot shown in FIG. 1 that shows the velcro strap in the closed position.

Shoe 40 has a sole 100 and an upper 102 secured to sole 100. As shown in FIG. 2A, the sole 100 includes a lower surface 104 that may have a tread pattern indicated generally at 106. Sole 100 may be made of conventional materials used in the manufacture of conventional sport shoes. A wide variety of tread patterns 106 may be used that are suitable for outdoor use. The upper 102 of shoe 40 may be made of any suitable waterproof and breathable material. An example of a suitable material is Gore-Tex®. Alternatively, the upper 102 of shoe 40 may be made of a thermally moldable material. An example of a suitable material is Ultralon® foam. Upper 102 may include a wide variety of aesthetically appealing designs.

The upper 102 of shoe 40 includes an upper opening 108, a front end 110, a medial side 112 and a lateral side 114. Upper 102 further includes a longitudinal opening 116 extending from the upper opening 108 toward the front end 110, separating the medial 112 and lateral 114 sides. Shoe 40 may further include a tongue 120 secured at a lower end 122 and is disposed underneath the longitudinal opening 116 to upper 108. The tongue width spans, and is connected, to medial 112 and lateral 114 sides such that the shoe has a permanent connected tongue underneath longitudinal opening 116. Over the tongue 120 the longitudinal opening 116 may include a closure devise such as a zipper 124 formed therein and extending from lower end 122 to upper opening 108. Tongue 120 may be made of a waterproof material. An example of a suitable material is Neoprene.

Shoe 40 may further include a upper tightening device indicated generally at 126, that extends between upper medial 112 and upper lateral 114 sides, across longitudinal opening 116 and upper opening 108. In the illustrated embodiment, the tightening device 126 is a Velcro strap that extends between upper medial 112 and upper lateral 114 sides. However, tightening device 126 may comprise other suitable devices such as a plurality of shoelaces, for example. Tightening device 126 may be adjusted as required to provide the desired fit for the particular user.

Figure 3B:
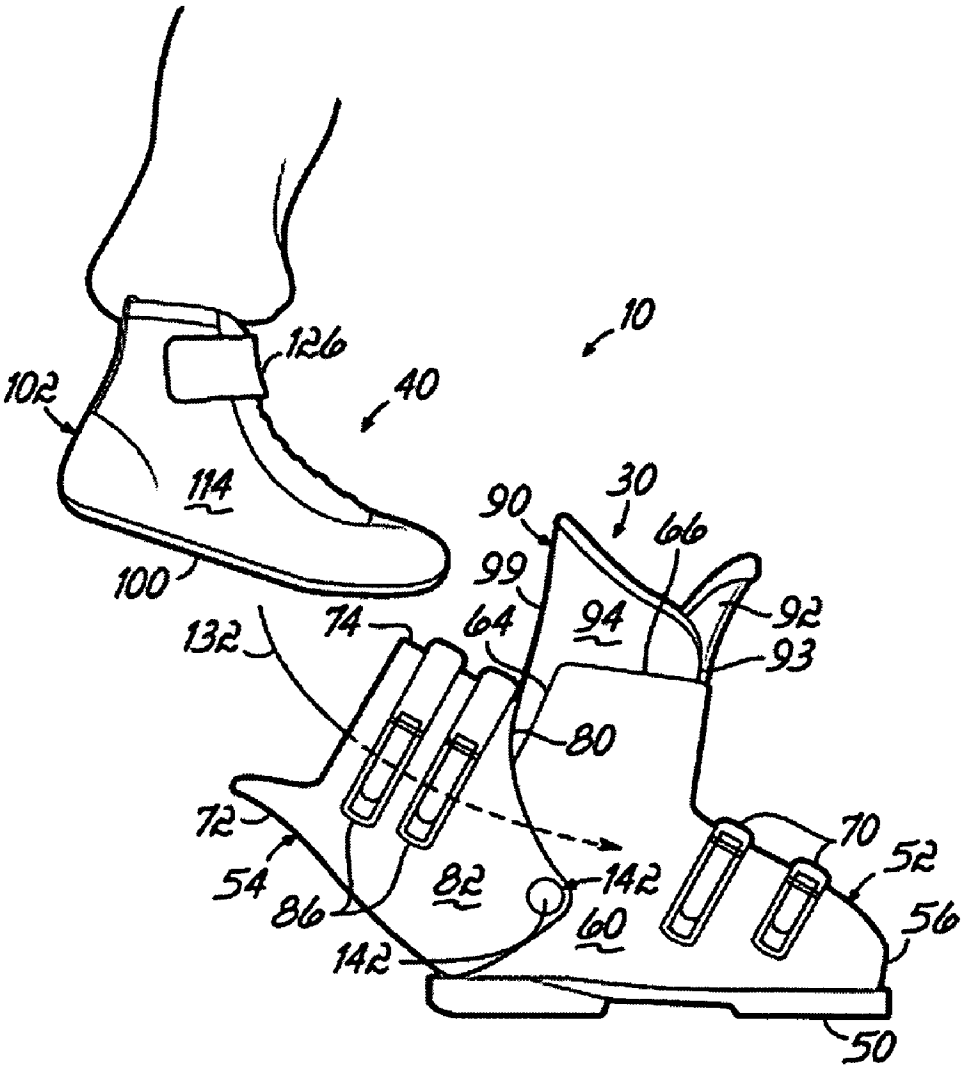
FIG. 3B is a side elevation view similar to FIG. 3A but with the heel and cuff portion pivoted to a lower position and with the shoe, secured to the user's foot, illustrated as being insertable into the inner liner in a substantially rearward to forward direction.
Figure 3A:
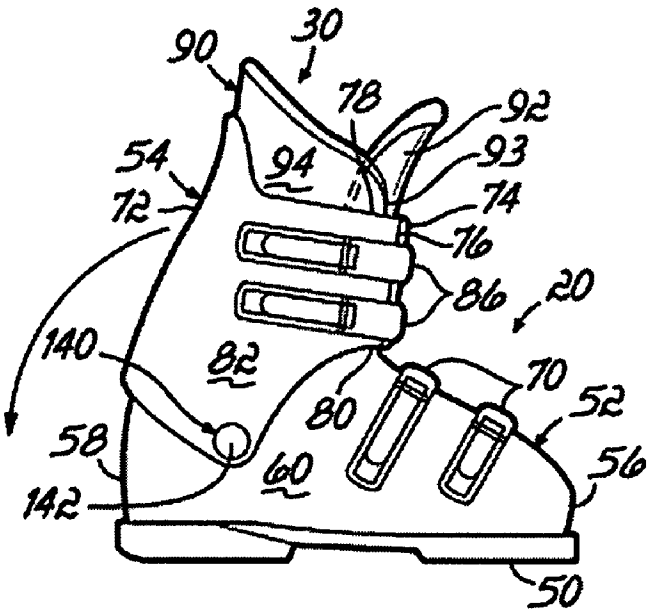
FIG. 3A is a side elevation view of the outer shell and inner liner of the ski boot shown in FIG. 1, with the inner liner inserted into the outer shell, and the heel and cuff portion of the outer shell in an upper position, which is a locked use position.
Figure 4A:
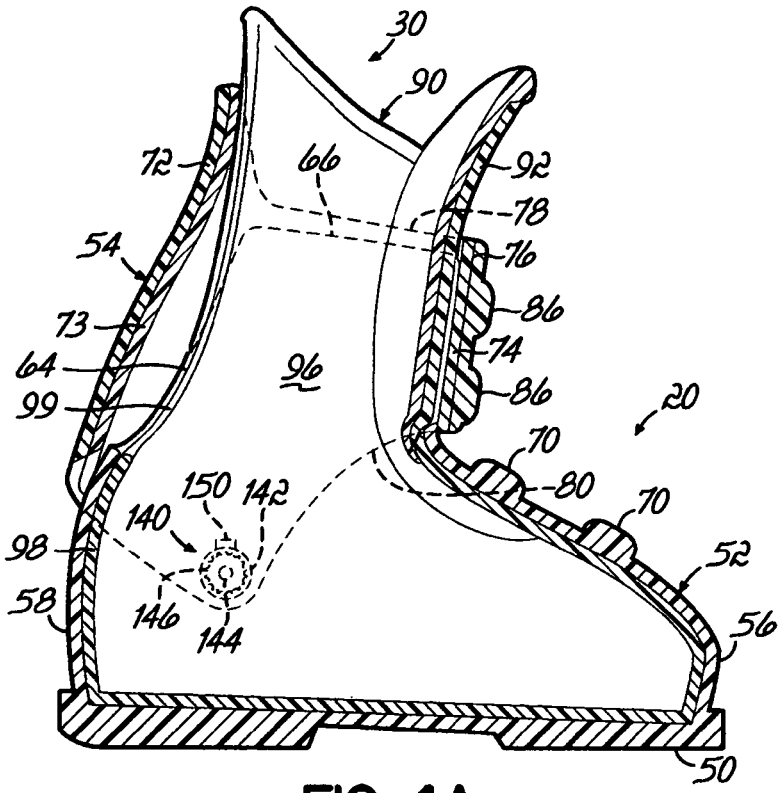
FIG. 4A is a cross-sectional view corresponding to FIG. 3A.
Figure 4B:
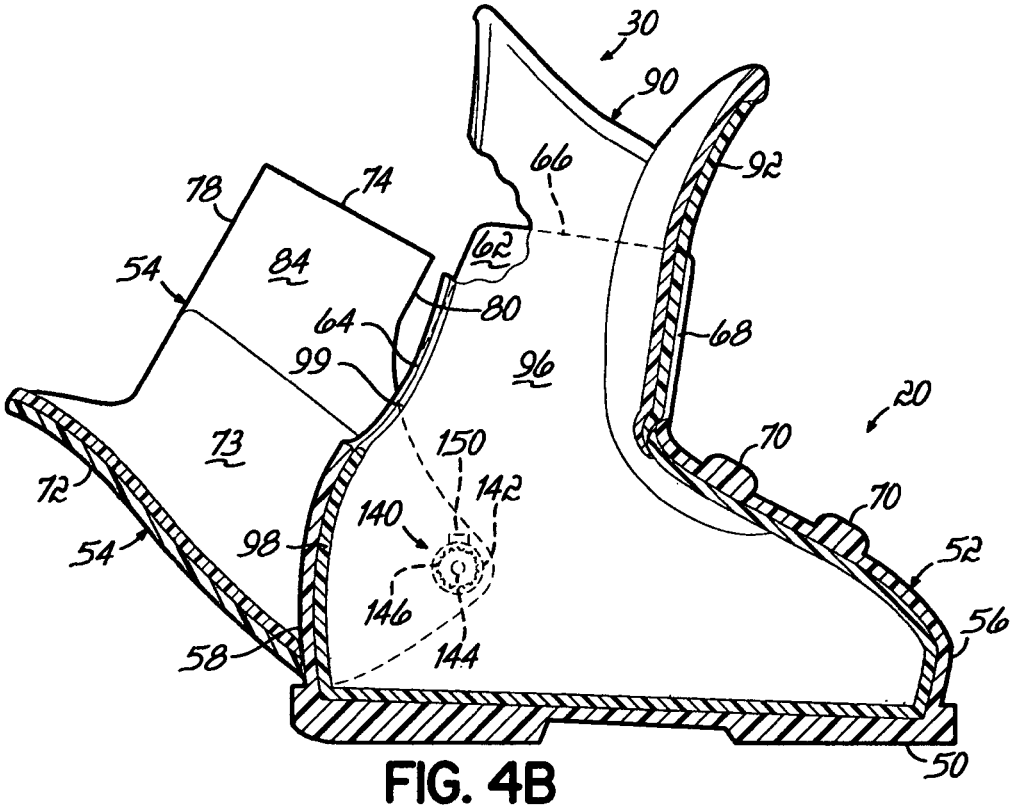
FIG. 4B is a cross-sectional view corresponding to FIG. 3B.
Figure 4C:
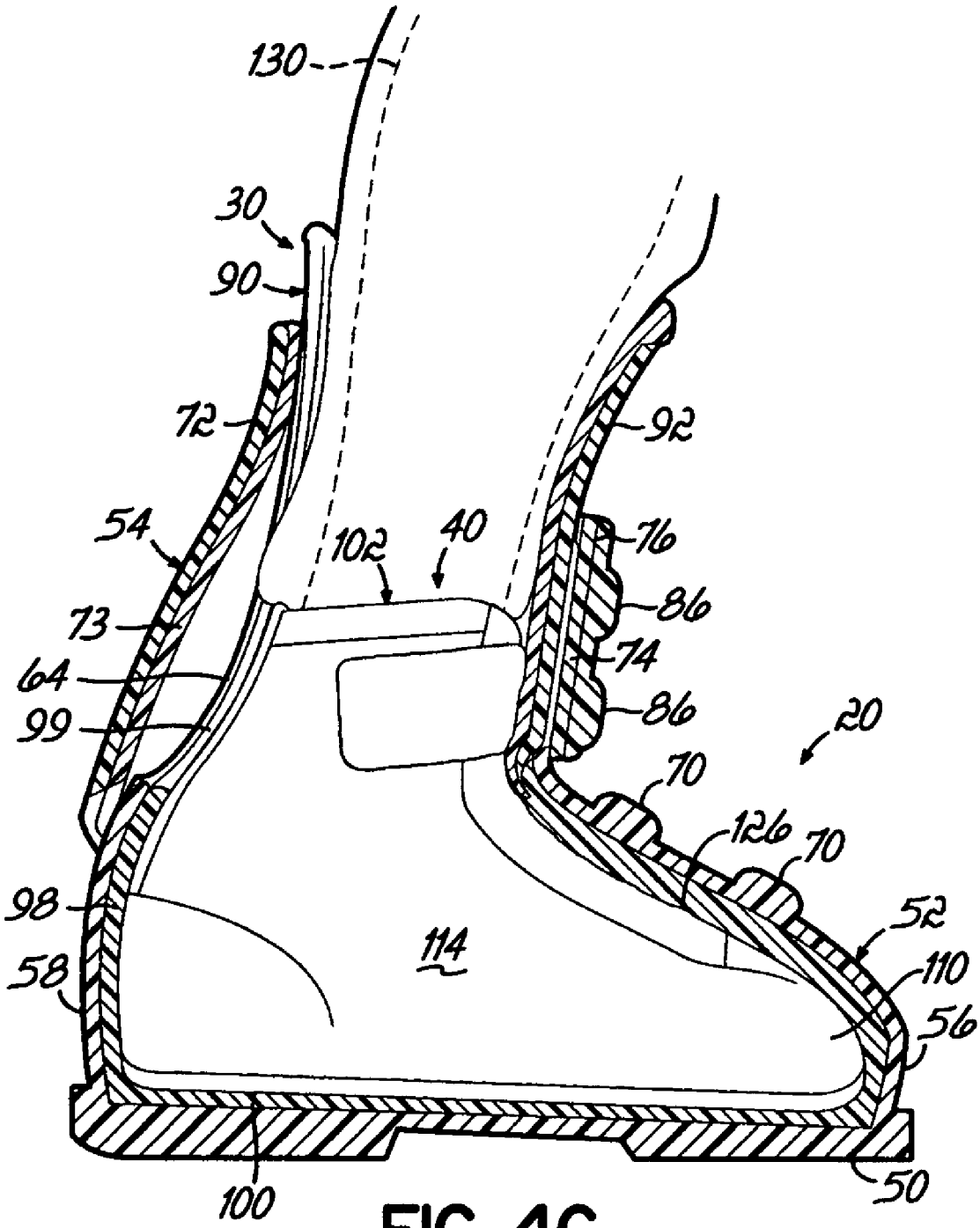
FIG. 4C is a cross-sectional view corresponding to FIG. 3C.

The insertion of shoe 40, and the user's foot and lower leg 130, into the inner liner 30 can be further appreciated with reference to FIGS. 3A-3C and 4A-4C. Prior to the initial use of ski boot 10, the following steps may be taken to mold or form the inner liner 30 to the shape of shoe 40. The heel and cuff portion 54 is pivoted to the lower position shown in FIGS. 3B and 4B. The lateral 82 and medial 84 sides of heel and cuff portion 54 are separated, which can be done due to the presence of slit 76, and the lateral 60 and medial 62 sides of outer shell 20 are separated, which can be done due to the presence of slit 64. The inner liner 30 is then inserted into shell 20 in a substantially rearward to forward direction. FIGS. 3A, 4A and 5 illustrate inner liner 30 inserted into outer shell 20, and FIG. 5 illustrates the lateral 82 and medial 84 sides of heel and cuff portion 54 in a separated position shown in phantom line.

A heating device (not shown) is then inserted into the inner liner 30 to heat the thermally moldable material to a suitable temperature that allows the material to be shaped or formed. Any suitable heating device, such as heated blocks of solid material, may be used to heat inner liner 30. The shoe 40 is secured to the foot (not shown) and lower leg 130 of the user as shown in FIG. 3B. Then shoe 40 and the user's foot and lower leg 130 are inserted into the inner liner 30, which has been inserted into outer shell 20, in a substantially rearward to forward direction indicated generally at 132 illustrated in FIG. 3B. The lateral 82 and medial 84 sides of heel and cuff portion 54, and the lateral 60 and medial 62 sides of outer shell 20, are separated as discussed previously. The lateral 94 and medial 96 sides of inner liner 30 are also separated, which can be accomplished due to the presence of slit 99. Shoe 40 and the user's foot and lower leg 130 are then inserted into the inner liner 30 in the substantially rearward to forward direction 132.

After the shoe 40 and the user's foot and lower leg 130 have been inserted into inner liner 30, the heel and cuff portion 54 is pivoted to the upper use or skiing position. Fastening devices 70 of outer shell 20 and fastening devices 86 of heel and cuff portion 54 are adjusted to provide the required snug fit for the particular user. The forces exerted by shoe 40 and the user's foot and lower leg 130, as well as the fastening devices 70 and 86 cause the inner liner 30 to be shaped or molded to form to the shape of shoe 40 and the lower leg 130.

It is not necessary to heat the inner liner 30 during subsequent uses as it will retain, or substantially retain, its customized shape. The inner liner 30 remains secured to outer shell 20 and the user inserts his foot, lower leg 130 and shoe 40 into the inner liner 30 as discussed previously for all subsequent uses. The user may remove his foot, lower leg 130 and shoe 40 by performing the foregoing procedure in reverse order.

Figure 3D:
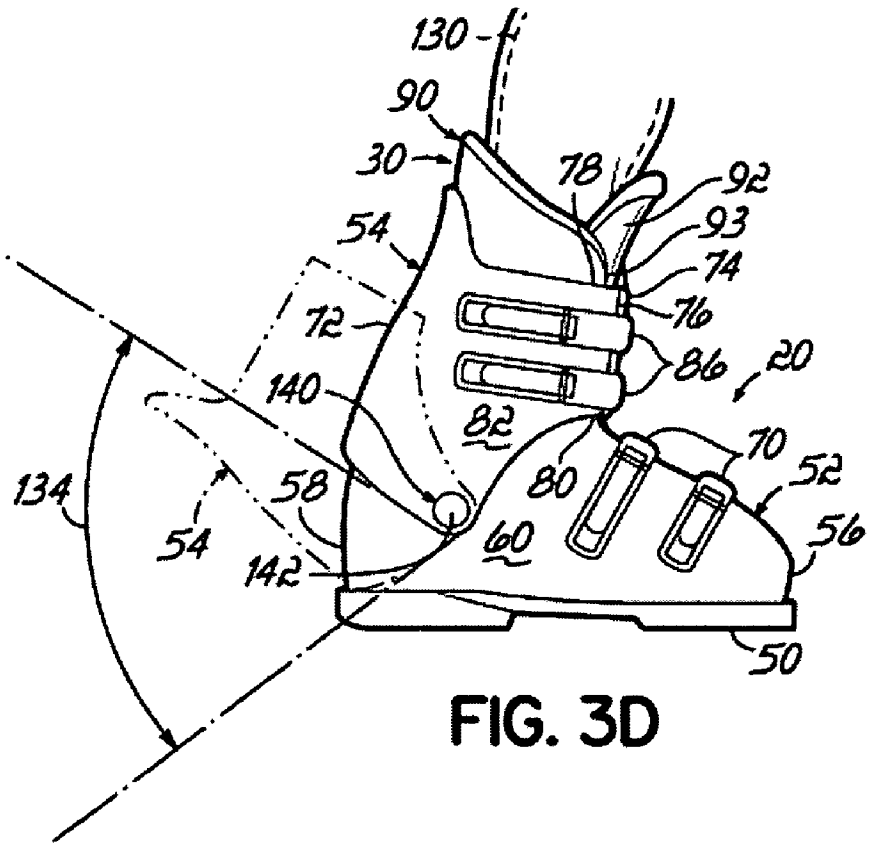
FIG. 3D is a side elevation view similar to FIGS. 3A-3C, but with the heel and cuff portion illustrated in both the upper position and the lower position (in phantom line) to further illustrate the arc through which the heel and cuff portion may be pivoted.
Figure 3C:
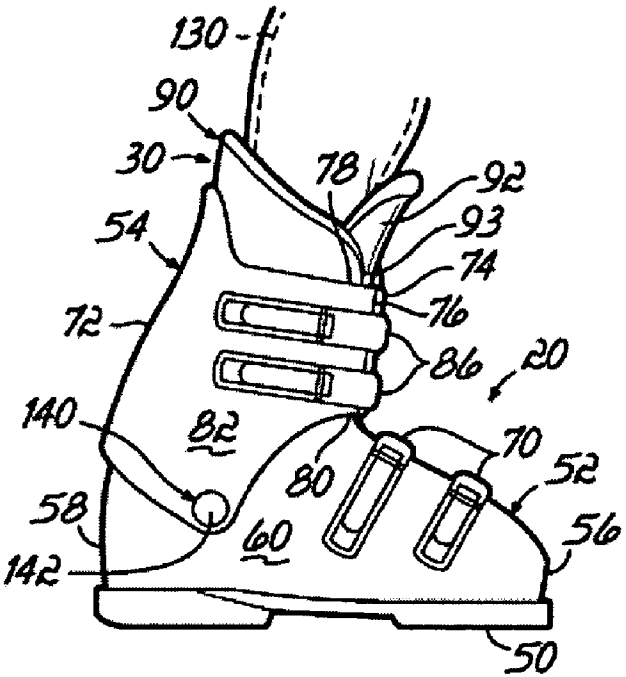
FIG. 3C is a side elevation view similar to FIGS. 3A and 3B, but with the shoe and user's foot and lower leg portion inserted into the inner liner and with the heel and cuff portion pivoted back to the upper locked position.

In one embodiment, the heel and cuff portion 54 pivots through an arc 134 (shown in FIG. 3D) of about seventy degrees from the upper position, which is the use or skiing position, shown in FIGS. 3A, 3C, 3D, 4A and 4C to the lower position shown in FIGS. 3B and 3D, used to insert the user's foot and lower leg 130 and shoe 40 into the inner liner 30 and outer shell 20. FIG. 3D illustrates the heel and cuff portion 54 in both the upper (solid line) and lower (phantom line) positions to further illustrate arc 134. In other embodiments, the arc may be greater than or less than seventy degrees provided that the shoe 40 may be inserted into inner liner 30 in a substantially rearward to forward direction. The heel and cuff portion 54 is pivotally coupled to upper 52 of outer shell 20 by a pair of pivot devices. In the illustrated embodiment, a pair of pivot devices 140 are used to pivotally couple heel and cuff portion 54 to outer shell 20. Each pivot device 140 includes a head 142 disposed exterior of one of the lateral 82 and medial 84 sides of heel and cuff portion 54. Head 142 is integral with a shaft 144 that extends through heel and cuff portion 54 and outer shell 20 into the interior of shell 20, between shell 20 and inner liner 30. A toothed gear 146 is secured to shaft 144 and is disposed within the interior of shell 20. A locking member, indicated schematically at 150 is secured at one end to shell 20 and engages the toothed gear 146. Head 142, shaft 144 and gear 146 pivot together as the heel and cuff portion 54 is pivoted relative to outer shell 20. The locking member 150 is flexible enough to permit gear 146 to be pivoted by the user but is stiff enough to retain heel and cuff portion 54 in a particular position when the user releases portion 54. The tooth 150 may also be biased by a spring (not shown) in another embodiment. Head 142, shaft 144, gear 146 and tooth member 150 may be made of nylon, a plastic material or other suitable material. Although gear 146 includes teeth extending 3600 around the entire perimeter thereof it may be appreciated that gear 146 may include teeth around only a portion of the gear 146 corresponding generally to the arc through which the heel and cuff portion 54 pivots.

Additionally, a variety of other pivot devices may be used in lieu of pivot devices 140 to couple the heel and cuff portion 54 to upper 52 of outer shell 20. Such alternative pivot devices may include, but are not limited to, the following. In one embodiment, each pivot device may include the gear 146 or a toothed track, which may be made of nylon, plastic or other suitable material, secured to an inner surface of shell 20. Each pivot device may also include the locking member 150 coupled to shaft 144 opposite head 142, so that each locking member 150 engages the corresponding gear 146 or the toothed track and pivots with head 142 and shaft 144 as heel and cuff portion 54 is pivoted relative to shell 20.

In another embodiment, each pivot device may include a toothed strap or cable (not shown) secured within a channel (not shown) formed in the inner surface of the upper 52 of shell 20. Each strap may be coupled to heel and cuff portion 54 by a suitable coupling member (not shown), so that the strap translates past a locking member such as locking member 150 that is secured to the inner surface of the upper 52 of shell 20 and engages the strap. The strap and locking member may be made of nylon, plastic or other suitable material.

In another embodiment, the ski boot may include a device (not shown) that allows the heel and cuff portion 54 to translate rearward relative to the upper 52 of the outer shell 20 and to pivot relative to upper 52. This configuration may permit the heel and cuff portion to pivot through a greater arc between the upper and lower positions discussed previously, with both positions illustrated in FIG. 3D.

In another embodiment, the ski boot may include a one way clutch mechanism (not shown) which will allow heel and cuff portion 54 to translate rearward relative to upper 52 of the outer shell 20. The one way clutch mechanism will include an movable inner shaft member (not shown), a stationary outer race member (not shown), a number of pawl members and notches located on the inside of the outer race (not shown), and a variety of spring mechanisms that can cause the pawl members to be engaged or disengaged (not shown). The slated inner shaft member will act as a rivot currently does now with typical overlap ski boots (a rivot connects the lower portion of the ski boot to the upper overlap portion of the ski boot). The inner shaft member (not shown) will be able to rotate inside the outer race member. The one way clutch mechanism will allow the heel and cuff portion to rotate from a closed skiing position to an open non skiing position only when the pawls are disengaged via an unlocking spring mechanism.

In another embodiment, each pivot device may be configured to permit the user to release the locking member (not shown) from the toothed member (not shown). This may be accomplished in a variety of ways.

Also, it is conceivable within the scope of the present invention that only one of the pair of pivot devices, for each embodiment of pivot devices, includes a locking feature.

While the present invention has been illustrated by the description of and exemplary embodiment thereof and while the embodiment has been described in considerable detail, it is not intended to restrict or in any way limit the scope of the appended claims to such detail. Additional advantages and modifications will readily appear to those skilled in the art. For example, in the illustrated embodiment ski boot 10 includes an outer shell 20, an inner liner 30 secured to the outer shell 20 and a shoe 40 insertable into and removable from the inner liner 30. However, in another embodiment the ski boot can include an outer shell and an inner liner insertable into and removable from the outer shell. In this embodiment, the outer shell also includes an upper and a heel and cuff portion pivotally coupled to the upper, as shown in the illustrated embodiment. This pivotal coupling, in conjunction with slits formed in the rear portion of the upper of the outer shell and in the front portion of the heel and cuff portion, permit the inner liner to be inserted into the outer shell in a substantially rearward to forward direction. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A ski boot, comprising:
an outer shell;
an inner liner disposed within said outer shell;
a shoe insertable into and removable from said inner liner, wherein:
said shoe comprises a sole having a lower surface and a tread pattern formed therein; and wherein:
said shoe further comprises an upper secured to said sole;
said upper comprises an upper opening, a front end, a medial side and a lateral side;
said upper further includes a longitudinal opening extending from said upper opening toward said front end, said longitudinal opening separating said medial side and said lateral side; and
said shoe further comprises a tongue secured at a lower end thereof to said upper and along lateral and medial sides with said tongue being disposed underneath said longitudinal opening.

2. A ski boot as recited in claim 1, wherein:
said inner liner is secured to said outer shell.

3. A ski boot as recited in claim 1, wherein:
said outer shell comprises an upper and a heel and cuff portion; and
said heel and cuff portion is disposed outward of said upper and is pivotally coupled to said upper.

4. A ski boot as recited in claim 3, wherein:
said heel and cuff portion is pivotal through an arc from an upper, use position to a lower position; and
said shoe is insertable into said inner liner in a substantially rearward to forward direction when said heel and cuff portion is in said lower position.

5. A ski boot as recited in claim 4, wherein:
said arc is at least about seventy degrees.

6. A ski boot as recited in claim 4, wherein:
said upper of said outer shell comprises a rear portion and a slit formed therein;
said inner liner comprises a rear portion and a slit formed in said rear portion;
said heel and cuff portion of said outer shell comprises a forward portion and a slit formed therein;
said slit in said rear portion of said upper of said outer shell, said slit in said rear portion of said inner liner and said slit in said forward portion of said heel and cuff portion of said outer shell combine to permit said shoe to be insertable into said inner liner in a substantially rearward to forward direction.

7. A ski boot as recited in claim 3, further comprising;
at least one pivot device; wherein
said at least one locking pivot device pivotally couples said heel and cuff portion of said outer shell to said upper of said outer shell.

8. A ski boot as recited in claim 7, wherein said at least one locking pivot device comprises:
a head disposed exterior of said heel and cuff portion;
a toothed gear coupled to said head and disposed inside said outer shell;
a locking member disposed inside and secured to said outer shell; wherein
said head and said toothed gear are pivotal with said heel and cuff portion and said locking member engages said toothed gear as it pivots.

9. A ski boot as recited in claim 1, wherein:
at least a portion of said inner liner is made of a thermally moldable material.

10. A ski boot as recited in claim 1, wherein:
said outer shell comprises a sole and an upper secured to said sole, said upper being made of a plastic material.

11. A shoe as recited in claim 1, wherein:
at least a portion of said shoe is made of a weatherproof material and moldable material.

12. A ski boot as recited in claim 1, wherein:
said longitudinal opening includes a closure devise such as a zipper formed therein.

13. A ski boot as recited in claim 1, wherein:
said shoe comprises a tightening device extending between said medial side and said lateral side across said longitudinal opening.

14. A ski boot as recited in claim 13, wherein:
said tightening device comprises a strap having hooks and fasteners.

15. A ski boot as recited in claim 1, wherein:
said inner liner is bonded to said outer shell.

* * * * *